US012337207B2

(12) United States Patent
Chevalier

(10) Patent No.: US 12,337,207 B2
(45) Date of Patent: Jun. 24, 2025

(54) MULTI-PURPOSE EXERCISE DEVICE USING BANDS

(71) Applicant: Jason Chevalier, Mesa, AZ (US)

(72) Inventor: Jason Chevalier, Mesa, AZ (US)

( * ) Notice: Subject to any disclaimer, the term of this patent is extended or adjusted under 35 U.S.C. 154(b) by 201 days.

(21) Appl. No.: 18/117,085

(22) Filed: Mar. 3, 2023

(65) Prior Publication Data

US 2024/0042266 A1 Feb. 8, 2024

Related U.S. Application Data

(60) Provisional application No. 63/394,505, filed on Aug. 2, 2022.

(51) Int. Cl.

| | |
|---|---|
| ***A63B 21/04*** | (2006.01) |
| ***A63B 21/00*** | (2006.01) |
| ***A63B 21/055*** | (2006.01) |
| ***A63B 21/16*** | (2006.01) |
| *A63B 71/06* | (2006.01) |

(52) U.S. Cl.

CPC ..... *A63B 21/156* (2013.01); *A63B 21/0557* (2013.01); *A63B 21/169* (2015.10); *A63B 2071/0658* (2013.01); *A63B 2220/833* (2013.01); *A63B 2225/50* (2013.01)

(58) Field of Classification Search

CPC ..... A63B 21/156; A63B 21/0557; A63B 21/0442; A63B 21/0552

See application file for complete search history.

(56) References Cited

U.S. PATENT DOCUMENTS

| | | | | |
|---|---|---|---|---|
| 6,319,179 | B1 * | 11/2001 | Hinds | A63B 21/156 482/121 |
| 6,689,025 | B2 * | 2/2004 | Emick | A63B 21/04 482/121 |
| 7,563,213 | B2 * | 7/2009 | Grant | A63B 21/04 482/122 |
| 10,709,954 | B1 * | 7/2020 | Stark | A63B 21/00065 |
| 11,452,898 | B2 * | 9/2022 | Corrigan | A63B 21/00065 |
| 11,938,365 | B1 * | 3/2024 | Dorsey | A63B 21/00065 |
| 2001/0046928 | A1 * | 11/2001 | Nette | A63B 21/0552 482/55 |
| 2012/0065035 | A1 * | 3/2012 | Makula | A63B 21/154 482/129 |
| 2013/0035220 | A1 * | 2/2013 | Adams | A63B 21/4035 482/129 |
| 2014/0038777 | A1 * | 2/2014 | Bird | A63B 23/03525 482/5 |

(Continued)

*Primary Examiner* — Joshua T Kennedy

(74) *Attorney, Agent, or Firm* — Accelerate IP LLC

(57) ABSTRACT

A multi-purpose exercise device comprising a top support having a first side and a second side wherein the top support can be coupled to a bottom support by a main support extending between the top support and the bottom support. A first pulley can be rotatably coupled to the first side and a second pulley that can be rotatably coupled to the bottom support. A main pulley can be rotatably coupled to a band slide. A main slide can be slidably coupled to the main support. At least one cable slidably can be coupled between the at least one pulley, the third pulley, the main pulley and the band slide and the at least one band can be removably coupled to the band slide and a bottom band retainer. The top support and the bottom support can be coupled to each other by at least one band slide tube.

19 Claims, 6 Drawing Sheets

(56) References Cited

U.S. PATENT DOCUMENTS

| | | | | |
|---|---|---|---|---|
| 2021/0283451 | A1* | 9/2021 | Gvoich | A63B 23/03541 |
| 2022/0054878 | A1* | 2/2022 | Thach | A63B 21/156 |
| 2022/0379158 | A1* | 12/2022 | Harwerth | A63B 21/4033 |
| 2024/0325815 | A1* | 10/2024 | Larson | A63B 21/063 |

* cited by examiner

MULTI-PURPOSE EXERCISE DEVICE USING BANDS

CROSS REFERENCE TO RELATED APPLICATION

This application claims benefit from currently U.S. Provisional Application No. 63/394,505 titled "Multi-Purpose Exercise Device using Bands" and having a filing date of Aug. 2, 2022, all of which is incorporated by reference herein.

FIELD OF THE INVENTION

The present specification relates generally to a device for securing resistance band to a workout machine and more specifically a compact, functional workout training system that is adjustable and providing the user multiple workouts with resistance bands through one system.

BACKGROUND OF THE INVENTION

There are numerous types of exercise equipment in the art each focusing on specific type of exercise or multiple exercises on one machine. When using exercise equipment, the main focus of these machines is to break the user's chosen exercise into aerobic and anaerobic exercise. Aerobic exercise refers to providing exercise through the use of cardiovascular conditioning which consists of high impact or low impact exercise. High-impact exercises consist of jolting movements that put a lot of force on the individual's bones and joints. Examples of high-impact exercises involve running or jogging on a treadmill or outdoors, jumping rope, cross-fit, plyometric exercises, or other similar exercises. Whereas low impact exercises are less jarring on the body and joints and less intense overall. Examples of low impact exercises include working out on an elliptical machine, cycling, swimming and home exercise.

Anaerobic exercise uses a different form of energy than aerobic where it includes high-intensity interval training, weightlifting, circuit training, and other forms of strength training. Numerous exercise equipment for both aerobic and anaerobic exercise have been developed for home use. Common exercise equipment includes the use of big, bulky machines that use weights stacked on top of each other where the weights are attached to cabling on one end and runs through a system of pulleys and are attached to a handle on the other side. These machines usually require a lot of room within a room and usually weigh hundreds of pounds making it hard for the user to easily move the machine. Commonly these machines have different stations that work out different muscles in the user's body or are tailored to one muscle area requiring multiple machines to work out different muscles within the user's body. These types of weight training machines require the use of weights that are stacked to add the necessary resistance to the user to build or tone different muscles within their body.

Another common method of weight training is the use of resistance and strength bands. Resistance bands are typically made from a flexible material such as a latex or synthetic rubber. Resistance bands come in varying levels of resistance and shapes such as, flat bands, loops, or tubes. Using resistance bands provides the user with a similar and sometimes even greater muscle activity than weight training with machines or free weights. Compared to weights, resistant bands involve a lower amount of force on the joints allowing the user to use their muscles more than machines or free weights. Resistance bands provide variable resistance and as the user stretches the band the resistant gradually gets harder giving the user more control over the distance of the band. In addition, resistance bands provide stabilization from the user's body allowing the user's body to maintain the correct form when doing the exercise. The user's need to control the bands from snapping back means a greater use of the muscle through its whole range.

One of the disadvantages of resistance bands is that you need a fixed point such as a door or wall to different type of exercises to work the different muscles within the body. In addition, to exercise and build different areas of the body the user would need different heights. For example, doing curls requires the band to be below the user's waste and extend and retract the arms at the elbows whereas to work out the user's shoulders or to simulate pull-ups with the bands the user would need to put the bands above the user's body to simulate the pull-up bar all of which would require either a very large workout machine or multiple work out locations using the bands.

Therefore, there is a need for a functional trainer that is compact that it can fit in any size room and that uses a combination of resistant bands giving the user a rounder workout experience allowing the user to adjust to different workouts thus providing the user an eccentric and concentric workout.

BRIEF SUMMARY OF THE INVENTION

Accordingly, the present invention is a multi-purpose exercise device comprising a top support and a bottom support wherein the top support has a first pulley and a second pulley rotatably attached to the top support. A third pulley rotatably attached to the bottom support. At least one cable attached between the first pulley, second pulley, third pulley and a main pulley wherein the cable can be attached to a slide on its first end and its second end. At least one band wherein the at least one band is attached to at least one band support and the main pulley wherein the at least band support is attached to the bottom support.

The top support and the bottom support are attached to each other by at least one main support. The main pulley has a first attachment point. The top support has a front side and a back side wherein the first pulley is attached to the front side and the second pulley is attached to the back side. The first attachment point is a hook, swivel eye, rigid eye, or shackle. The at least one band can vary in thickness and resistance. The at least one band support is a hook, swivel eye, rigid eye or shackle that is attached to the bottom support. The first pulley, second pulley, third pulley and main pulley are cable, rope or band driven.

A multi-purpose exercise device coupled to a wall comprising a top support and a bottom support having a main support extending from the top support to the bottom support wherein the main support is coupled to the top support and to the bottom support. At least one pulley rotatably attached to the top support and a third pulley rotatably coupled to the bottom support. Aa main pulley rotatably coupled to a band slide. A main slide slidably coupled to the main support. At least one cable slidably coupled between the at least one pulley, the third pulley, the main pulley and the band slide.

At least one band removably coupled to the band slide and a bottom band retainer. The top support and the bottom support are coupled to each other by at least one band slide tube. The band slide is slidably coupled to the band slide tube. The at least one pulley is a first pulley, second pulley and a fourth pulley wherein the second pulley and the fourth pulley are rotatably coupled opposite of each other to the top support. The band slide has a top band retainer removably coupled to it.

The main slide comprises at least one handle attachment point wherein the handle attachment point has an outer plate and an inner plate that captures a top pulley and a bottom pulley sandwich between the outer and inner plate. The outer plate and inner plate can comprise at least one first hinge and the main slide has a second hinge wherein the first hinge and the second hinge are rotatably coupled to each by at least on hinge pin. The cable can be slidably coupled between the top pulley and the bottom pulley wherein the cable goes through a stopper and is attached to a carabiner. The main slide further comprises a spring plunger and at least one attachment point wherein the attachment point is a hook or round eye.

The main support has a plurality of holes extending from the top plate to the bottom plate wherein the plurality of holes can capture the spring plunger allowing the main slide to be adjustable up and down the main support. The at least one band varies in thickness and resistance. The at least one band support is a hook, swivel eye, rigid eye or shackle that is attached to the bottom support. The first pulley, second pulley, third pulley and main pulley are rotatably coupled together by the cable. The top plate and the bottom plate are attached to the wall by at least one fastener. The at least one band slide has a band slide tube attachment that is coupled to a tube slide wherein the band slide tube is Delrin, bearings, or plastic.

The cable is a rope, braided rope, twisted rope, steel cable, or polyester rope. The main support is bar stock, square tubing, or slotted framing. The multipurpose exercise device further comprises a computing system wherein the computing system comprises at least one computing device having a wireless communication module. At least one sensor wherein the sensors are attached to the computing device. A screen attached to the computing device.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the. Absent such clear statements of intent to apply a "special" definition, it is the inventor's intent and desire that the simple, plain, and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112 (f). Thus, the use of the words "function," "means" or "step" in the Detailed Description or Description of the Drawings or claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for" and will also recite the word "function" (i.e., will state "means for performing the function of . . . , without also reciting in such phrases any structure, material or act in support of the function. Thus, even when the claims recite a "means for performing the function of molding a . . . , step for performing the function of molding a . . . ," if the claims also recite any structure, material or acts in support of that means or step, or that perform the recited function, then it is the clear intention of the inventors not to invoke the provisions of 35 U.S.C. § 112 (f). Moreover, even if the provisions of 35 U.S.C. § 112 (f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

Additional features and advantages of the present specification will become apparent to those skilled in the art upon consideration of the following detailed description of the illustrative embodiment exemplifying the best mode of carrying out the invention as presently perceived.

BRIEF DESCRIPTION OF THE DRAWINGS

These and other features, aspects, and advantages of the present specification will become better understood with regard to the following description, appended claims, and accompanying drawings where:

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 1:
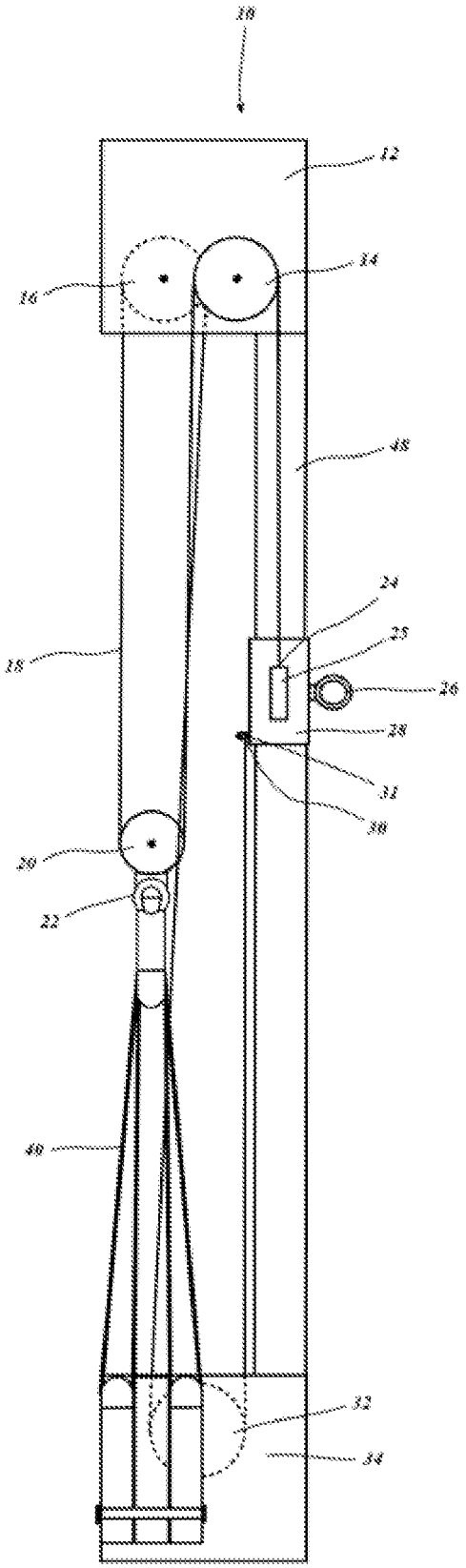
FIG. 1 is a front view of the multi-purpose exercise device using bands in accordance to one, or more embodiments.
Figure 2:
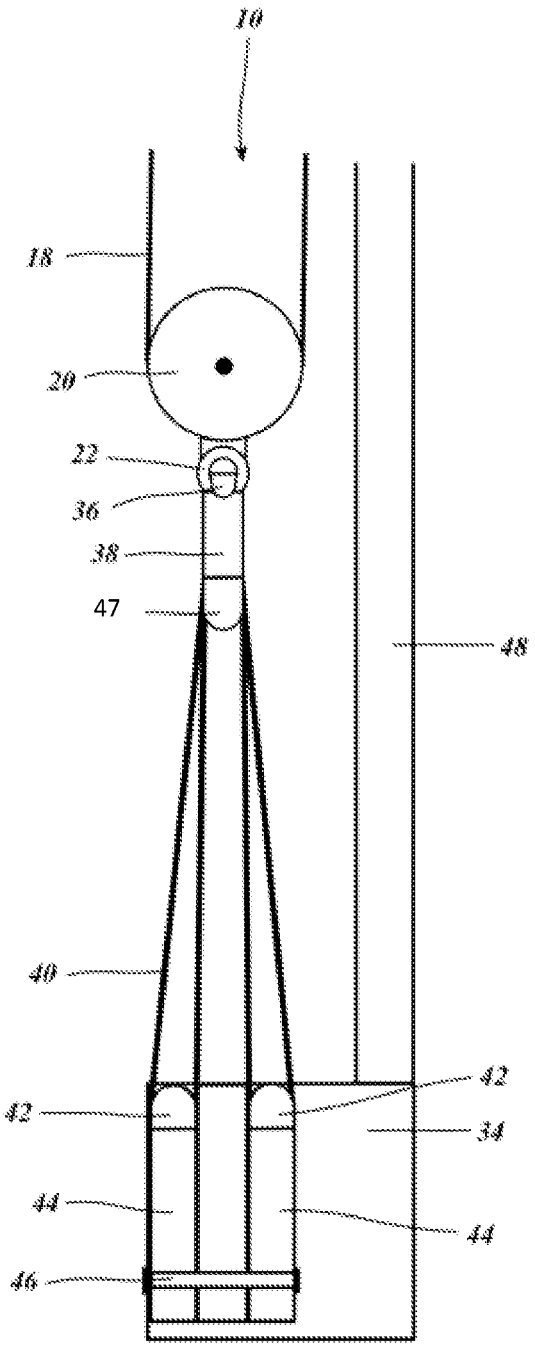
FIG. 2 is a partial back view of the multi-purpose exercise device using bands in accordance to one, or more embodiments.

Referring initially to FIG. 1-2, a multi-purpose exercise device is shown generally at 10. The multi-purpose exercise device 10 comprises a top support 12 and a bottom support 34 wherein the top support has a first pulley 14 and a second pulley 16 rotatably attached to the top support. The top support 12 and bottom support 34 can have a front side and a back side wherein the first pulley 14 can be on the front side of the top support and the second pulley 16 can be on the back side of the top support. In other embodiments the first pulley 14 can be on the back side of the top support 12 and the second pulley can be on the front side of the top support. The first pulley 14 and the second pulley 16 can rotate around an axis and can be supported by such as, for example, a pin, a bolt, a screw or the like. The top support 12 can have at least one hole (not shown) that the first pulley 14 and the second pulley 16 support can such as, for example, screw into, pressed into, secured into or the like.

The top support 12 can be attached to the bottom support 34 by at least one main support 48 wherein the main support can be such as, for example, welded, bolted, pinned or the like to the top support and the bottom support. The main support 48 can be such as, for example, a square tube, a round tube, an angle iron, a u channel, a t bar, a rectangular tube, or the like. The main support 48 can be manufactured from such as, for example, stainless steel, aluminum, carbon steel, plastic, carbon fiber, or the like.

The bottom support 34 can have a third pulley 32 rotatably attached to the bottom support back side or in other embodiments its front side. The bottom support 34 can further comprise at least one band support 44 and in the preferred embodiment there can be a at least two band support 44 wherein the band support can be attached to the bottom support by at least one fastener or at least one bolt 46 that can capture or bolt on the band support to the bottom support. The band support 44 can be such as, for example, heavy duty hook, eye hook and carabiner, tie down ring, tie-down hook, clamp, look clamp, hold down bolts, or the like. The bottom support 34 and top support 12 can be any suitable shape such as, square, circular, rectangular, hexagonal or the like, but in the preferred embodiment it is square.

In embodiments, the multi-purpose exercise device 10 can further comprise at least one cable 18 having a first end 24 and a second end 30 attached between the first pulley 14, second pulley 16, third pulley 32 and a main pulley 20 wherein the cable can wrap around each pulley and can be attached to a slide 28. The slide 28 can glide on the top side or bottom side of the main support 48 wherein the slide can glide on top of the main support and can be attached by such as, for example, bearings, wheels, tongue and groove, sleeve and guide rail, carriage and rail, or the like. The at least one cable 18 can be such as, for example, rope, steel, cable, flat belt, shield cable, or the like.

Figure 4:
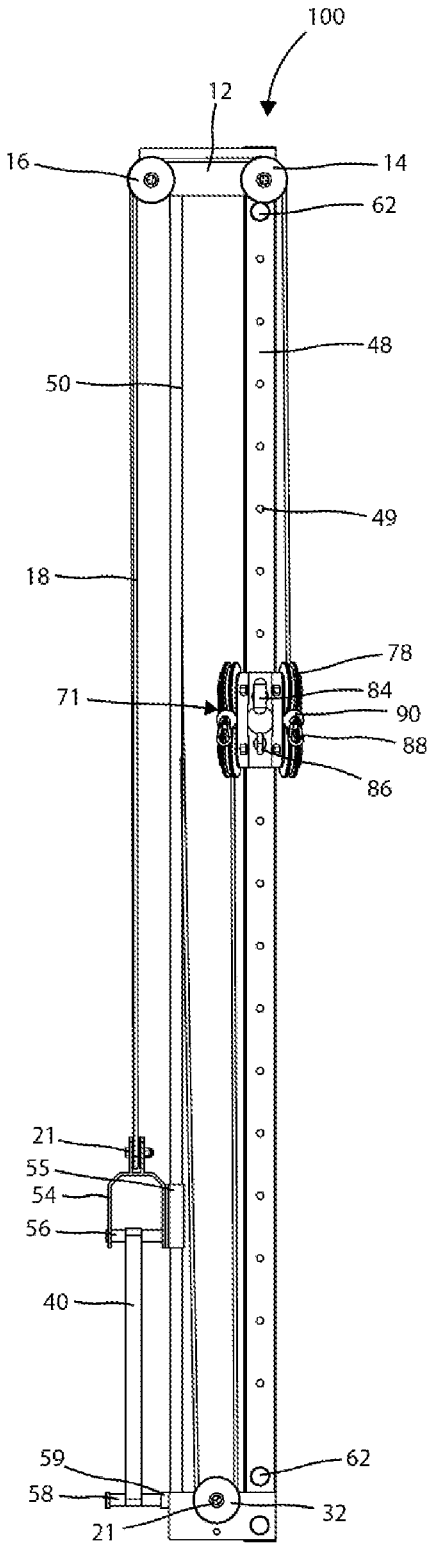
FIG. 4 is a front view of another embodiment of the multi-purpose exercise device using bands in accordance to one, or more embodiments.
Figure 5:
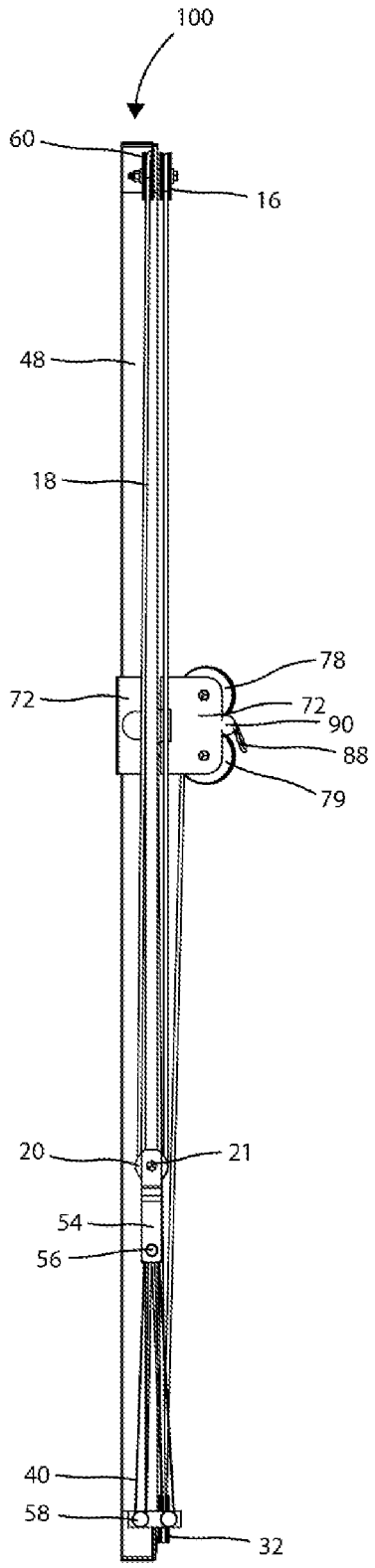
FIG. 5 is a right view of another embodiment of the multi-purpose exercise device using bands in accordance to one, or more embodiments.
Figure 6:
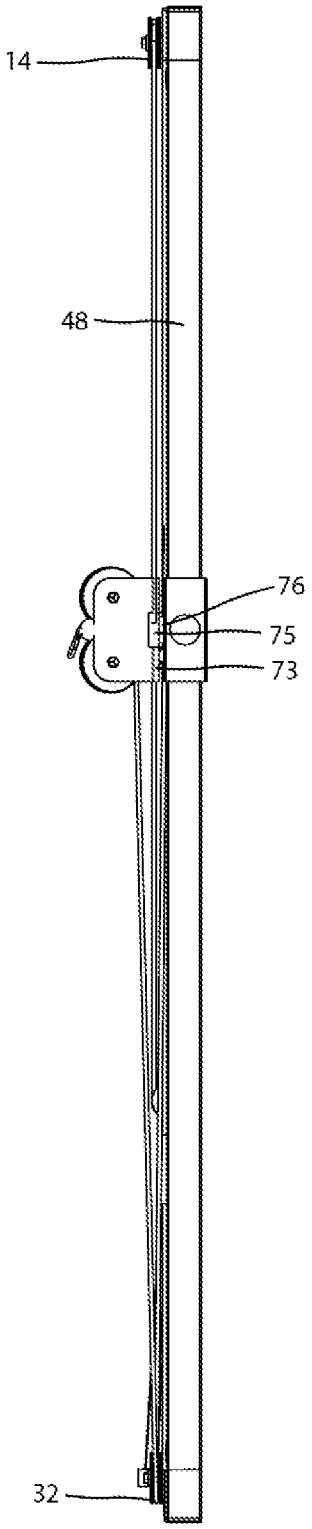
FIG. 6 is a left view of another embodiment of the multi-purpose exercise device using bands in accordance to one, or more embodiments.

The slide 28 can comprise a spring plunger 84 wherein the locking pin can lock the slide onto the main support 48 wherein the slide can have a hole or threaded hole for the locking pin to attach to as shown in FIG. 4. The spring plunger 84 can be such as, for example, t-handle quick release pin, knob-grip pin, L-handle pin, loop-grip pin, clevis pin, cotter pin, retractable spring plunger, or the like. The spring plunger 84 can put resistance on the main support 48 to keep the slide from moving, or the main body can have a plurality of holes extending from the lower portion to the upper portion of the main body allowing the locking pin to be inserted into the hole. The slide 28 can have a second attachment point 31 and a third attachment point 25 wherein the second attachment point can connect to or attach to the cable's second end 30 and the third attachment point can be attached to or connected to the cable's first end 24. The second attachment point 31 and the third attachment point 25 can be such as, for example, a clamp, an eyebolt, a swivel ring, a shackle hoist ring, tie down ring, joint rod end, screw eyes, or the like. The slide 28 can have a fourth attachment point 26 wherein the fourth attachment point can be a hook, eye bolt or the like.

In embodiments, the main pulley 20 can comprise at least one first attachment point 22 which can be attached to a hook attachment 36 wherein the first attachment point 22 can be such as, for example, heavy duty hook, eye hook and carabiner, tie down ring, tie-down hook, clamp, look clamp, hold down bolts, or the like. The first attachment point 22 can be attached to a hook 38 wherein the hook can be such as, for example, a J hook, a swivel eye, shackle, or the like wherein the hook can have be attached to the first attachment point by a hook, fastener, weld or the like on one end, and can have an band attachment point 47 wherein the band attachment point can be a J hook, or any other mechanism that allows the user to easily place the bands around the band attachment point. In certain embodiments, the hook can screw into or be attached directly to the first attachment point 22 or the main pulley.

In embodiments, the multi-purpose exercise device 10 can further comprise at least one band 40 wherein the at least one band can be attached to at least one band support 44 and the main pulley 20 wherein the at least one band support is attached to the bottom support 34. The at least one band support 44 can comprise a band attachment point 42 wherein the bands 40 can easily be secured to the main pulley 20 and the band support through the band attachment points which can be such as, for example, hooks, swivel eye, rigid eye, shackle, or the like. The bands 40 can be such as, for example, elastic bands, workout bands, loop bands, tube resistance bands, rubber bands, nylon bands, or the like wherein the bands can vary in thickness and resistance allowing the user to quickly change the bands in the multi-purpose exercise device 10 which can allow for the user to change resistance in their workout. The bands can vary in resistance from such as, for example, 0.1 lbs to 300 lbs.

The top support 12 and the bottom support 34 are attached to each other by at least one main support 48. The top support 12 has a front side and a back side wherein the first pulley 14 is attached to the front side and the second pulley 16 is attached to the back side. The first band attachment point 47 is a hook, swivel eye, rigid eye, or shackle. The at least one band 40 can vary in thickness and resistance. The at least one band support 44 is a hook, swivel eye, rigid eye or shackle that is attached to the bottom support. The first pulley 14, second pulley 16, third pulley 32 and main pulley 20 are cable, rope or band driven. In certain embodiments, the bottom support 34 and the top support 12 can be surrounded by an enclosure wherein one end is open to allow for the main support 48, at least one band 40, and at least one cable 18.

In embodiments, a computing system (not shown) can be attached to the top support 12 or the bottom support 34 wherein the computing system can be attached to one or more sensors that can measure the resistances provided by the bands 40, the number of sets and reps as the user uses the device 10, the user's information such as weight, height and body fat content, calories burned, heart rate, time of workout, and the like. The computing system can comprise a wireless communication module allowing the computing system to communicate with a portable computing device or a stationary computer. The computing system can upload the information to the cloud allowing the user to access the collected information remotely. The sensors can be such as, for example, pulse sensor, bi-axial or tri-axial load cell, knob load cell, proximity sensor, torque sensor, load button, accelerometer, force sensor, temperature sensor, humidity sensor or the like. The bottom support 34 or the top support 12 can have a screen attached to it where the user can input their information and see the status of their workout.

Referring now to FIGS. 3-6, the multi-purpose exercise device 100 can comprise a top support 12 and a bottom support 34 coupled to a main support 48 and a band slide tube 50 that can extend between the top support and the bottom support. The main support 48 and the band slide tube 50 can be spaced from each other and can extend at a distance between the top support 12 and the bottom support 34. The main support 48 and the band slide tube 50 can be coupled to the top support 12 and the bottom support 34 by such as, for example, weld, fastener, braze, solder, joint attachment, or the like. In certain embodiments the main support 48 can be coupled to at least one sleeve that is coupled to both the top support 12 and bottom supports 34. In embodiments, the main support 48 can be such as, for example, a square tube, a round tube, an angle iron, a u-channel, a t-bar, a rectangular tube, or the like. The band slide tube 50 can be such as, for example, a round tube, bar stock, rods, a square tube, an angle iron, a u-channel, a t-bar, a rectangular tube, or the like. The main support 48 can have a plurality of holes 49 evenly or unevenly spaced longitudinally down the main support. The plurality of holes 49 can be the same size or can vary in size.

The top support 12 can have at least one pulley wherein the at least one pulley is a first pulley 14 and a second pulley 16 that can be rotatably coupled to the top support's front side and a fourth pulley 60 can be coupled to the top support's back side opposite the second pulley. The first pulley 14, second pulley 16 and fourth pulley 60 can be rotatably couple to the top support 12 by such as, for example, fastener, roller bearing, partially threaded fastener, or the like. The top support 12 can have at least one hole (not shown) for the user to place at least one fastener through to attach the top support to the user's wall and the hole can be covered with a hole cap 62 and in certain embodiments the cap can be omitted.

Figure 3:
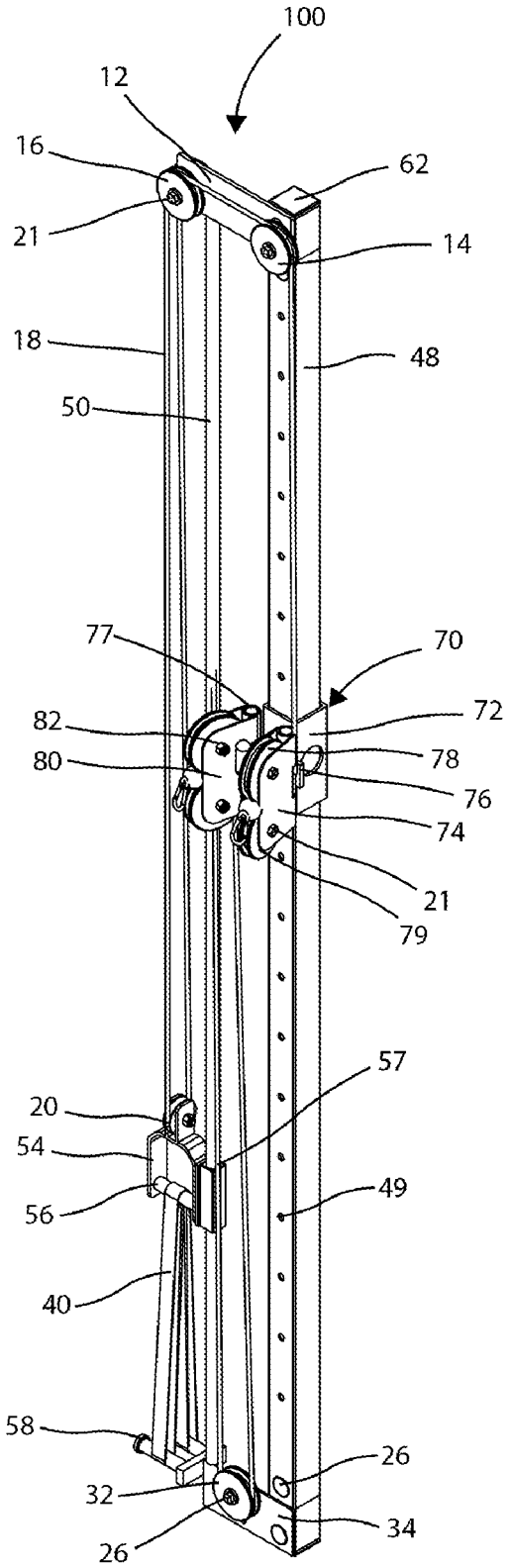
FIG. 3 is an isometric view of another embodiment of the multi-purpose exercise device using bands in accordance to one, or more embodiments.

A third pulley 32 rotatably coupled to the bottom support 34 wherein the bottom support can have at least one hole to accommodate a fastener 21 that can allow the rotatably coupling of the third pulley. The third pulley 32 can be on the same side as the first pulley 14 and the second pulley 16. The main pulley 20 can be rotatably coupled to a band slide 54 wherein the band slide can be any suitable shape, but in the preferred embodiment the shape is as shown in FIG. 3. The band slide 54 can be such as, for example, u-shaped, t-shaped, v-shaped or the like with can be made from such as, for example, flat bar steel, bar stock, sheet metal, or the like. The band slide can be slidably coupled to the band slide tube by a band slide tube attachment 55. The band slide 54 can be coupled to a band slide tube attachment 55 by such as, for example, weld, fastener, braze, or the like wherein the band slide tube attachment can be such as, for example, square tubing, round tubing, bar steel, or the like.

The band slide tube attachment 55 can have a through hole that allow for a bushing 57 to be coupled to the through hole. The bushing 57 can be such as, for example, nylon, Delrin, Teflon, bearings or the like that can allow the bushing to slide freely on the band slide tube 50. The band slide 54 can have a horizontal thru hole that a top band retainer 56 can be removably attached to wherein the top band retainer is such as, for example, tube steel, flat bar steel, bar stock, or the like. The top band retainer 56 can slide into the hole on the band slide and either be pinned, screwed or capture within the band slide allowing at least one band 40 to be captured by the top band retainer.

A main slide 70 can be slidably coupled to the main support 48. The main slide 70 can slide freely on the main support 48 and the main slide can be the same or similar shape as the main slide. The main slide 70 can be such as, for example, square tubing, round tubing, rectangular tubing or the like. The main slide 70 comprises at least one handle attachment point 71 wherein the handle attachment point has an outer plate 74 and an inner plate 80 that captures a top pulley 78 and a bottom pulley 79 sandwich between the outer and inner plate. The outer plate 74 and inner plate 80 can comprise at least one first hinge 73 and the main slide has a second hinge 75 wherein the first hinge and the second hinge are rotatably coupled to each by at least on hinge pin 77. The first hinge 73, second hinge 75 and hinge pin 77 can allow the handle attachment point 71 rotate freely on the main slide. In the preferred embodiment, the main slide 70 has two handle attachment points 71 for the user to pull on.

The cable 18 can be slidably coupled between the top pulley 78 and the bottom pulley 79 wherein the cable goes through a stopper 90 and is attached to a carabiner 88 wherein the stopper can be such as, for example, ball stopper, bumper, ball, or the like. The carabiner can be such as, for example, hook, twist to lock carabiner, quick disconnect link, s-hook, slide release carabiner, or the like. The main slide 70 further comprises a spring plunger 84 and at least one fifth attachment point 86 wherein the fifth attachment point is a hook or round eye. The spring plunger can be such as, for example, t-handle quick release pin, knob-grip pin, L-handle pin, loop-grip pin, clevis pin, cotter pin, retractable spring plunger, or the like. The pulleys can be rotatably coupled between the inner plate 80 and the outer plate 74 by at least one fastener 21 and nut 82. The first pulley, second pulley, third pulley, fourth pulley, main pulley, top pulley, and bottom pulley can be such as, for example, flat belt pulley, rope pulley, cable pulley, tapered pulley, v-belt pulley, belt pulley, or the like.

The cable 18 can be slidably coupled between the first pulley, second pulley, third pulley, fourth pulley, main pulley top pulley, and bottom pulley as shown in FIG. 3 wherein the cable can stay tight as the main slide 70 moves up and down the main support 48 wherein as the user pulls on the end of the cable at the carabiners with an attachment the cables and pulleys will pull on the band slide reacting against the band 40. The tension on the bands 40 varies depending on the band resistance and whether the user pulls both or one of the handle attachments points 71.

At least one band 71 can be removably coupled to the band slide 54 and a bottom band retainer 58. The bottom band retainer 58 can be coupled to the bottom support 34 by a bottom band retainer attachment 59 by such as, for example, weld, braze, fastener, adhesive, or the like. In the preferred embodiment the multi-purpose exercise device 100 can have two bottom band retainers 58.

The plurality of holes 49 on the main support can capture the spring plunger 84 allowing the main slide 70 to be adjustable up and down on the main support 48 allowing the user to do different exercises. The at least one band support 58 can tube, bolt, a hook, swivel eye, rigid eye or shackle that is attached to the bottom band retainer attachment. The top support 12 and the bottom support 34 can be attached to the wall by at least one fastener. The cable 18 can be a rope, braided rope, twisted rope, steel cable, or polyester rope.

In closing, it is to be understood that although aspects of the present specification are highlighted by referring to specific embodiments, one skilled in the art will readily appreciate that these disclosed embodiments are only illustrative of the principles of the subject matter disclosed herein. Therefore, it should be understood that the disclosed subject matter is in no way limited to a particular methodology, protocol, and/or reagent, etc., described herein. As such, various modifications or changes to or alternative configurations of the disclosed subject matter can be made in accordance with the teachings herein without departing from the spirit of the present specification. Lastly, the terminology used herein is for the purpose of describing particular embodiments only and is not intended to limit the scope of the present disclosure, which is defined solely by the claims. Accordingly, embodiments of the present disclosure are not limited to those precisely as shown and described.

Certain embodiments are described herein, including the best mode known to the inventors for carrying out the methods and devices described herein. Of course, variations on these described embodiments will become apparent to those of ordinary skill in the art upon reading the foregoing description. Accordingly, this disclosure includes all modifications and equivalents of the subject matter recited in the claims appended hereto as permitted by applicable law. Moreover, any combination of the above-described embodiments in all possible variations thereof is encompassed by the disclosure unless otherwise indicated herein or otherwise clearly contradicted by context.

What is claimed is:

1. A multi-purpose exercise device to be coupled to a wall, the exercise device comprising:

a top support having a first side and a second side, the top support coupled to a bottom support by a main support extending between the top support and the bottom support;

at least one top pulley rotatably coupled to the first side and a bottom pulley rotatably coupled to the bottom support;

a main pulley rotatably coupled to a band slide;

a main slide coupled to the main support and adjustably moveable relative to the main support;

a first stopper and a second stopper coupled to the main slide;

a cable having a first end passing through the first stopper and a second end, passing through the second stopper and having a length between the first stopper and the second stopper that runs between the at least one top pulley, the bottom pulley, the main pulley and the band slide, wherein the first end has a first handle attachment and the second end has a second handle attachment, wherein pulling on the first handle attachment and the second handle attachment lifts the band slide without rotating the main pulley; and at least one band removably coupled to the band slide and a bottom band retainer.

2. The multi-purpose exercise device according to claim 1, wherein the top support and the bottom support are coupled to each other by at least one band slide tube.

3. The multi-purpose exercise device according to claim 2, wherein the band slide is slidably coupled to the band slide tube.

4. The multi-purpose exercise device according to claim 1, wherein the at least one top pulley is a first pulley, second pulley and a fourth pulley wherein the second pulley and the fourth pulley are rotatably coupled opposite of each other to the top support.

5. The multi-purpose exercise device according to claim 1, wherein the band slide is removably coupled to a top band retainer.

6. The multi-purpose exercise device according to claim 1, wherein the main slide comprises an outer plate and an inner plate that captures an upper pulley and a lower pulley sandwiched between the outer and inner plate.

7. The multi-purpose exercise device according to claim 6, wherein at least one of the outer plate and inner plate comprises at least one first hinge and the main slide has a second hinge wherein the first hinge and the second hinge are rotatably coupled by at least one hinge pin.

8. The multi-purpose exercise device according to claim 7, wherein the cable is slidably coupled between the upper pulley and the lower before passing through the first stopper or the second stopper.

9. The multi-purpose exercise device according to claim 8, wherein the at least one band slide has a band slide tube attachment that is coupled to a tube slide wherein the band slide tube is polyoxymethylene, acetal, bearings, or plastic.

10. The multi-purpose exercise device according to claim 8, wherein the cable is a rope, braided rope, twisted rope, steel cable, or polyester rope.

11. The multi-purpose exercise device according to claim 7, wherein the main support is bar stock, square tubing, or slotted framing.

12. The multi-purpose exercise device according to claim 6, wherein the main slide further comprises a spring plunger and at least one attachment point wherein the attachment point is a hook or round eye.

13. The multi-purpose exercise device according to claim 12, wherein the main support has a plurality of holes extending from the top plate to the bottom plate wherein the plurality of holes can capture the spring plunger allowing the main slide to be adjustable up and down the main support.

14. The multi-purpose exercise device according to claim 1, wherein the at least one band is multiple bands that vary in thickness and resistance.

15. The multi-purpose exercise device according to claim 1, wherein the bottom support is coupled to at least one band support which is a hook, swivel eye, rigid eye or shackle.

16. The multi-purpose exercise device according to claim 1, wherein the at least one top pulley and bottom pulley are rotatably coupled together by the cable.

17. The multi-purpose exercise device according to claim 1, wherein the top support and the bottom support are coupled to a wall by at least one fastener.

18. The multi-purpose exercise device according to claim 1, wherein the multipurpose exercise device further comprises a computing system wherein the computing system comprises:

at least one computing device having a wireless communication module;

at least one sensor wherein the sensors are attached to the computing device; and a screen attached to the computing device.

19. A multi-purpose exercise device to be coupled to a wall, the exercise device comprising:

a top support having a first side and a second side, the top support coupled to a bottom support by a main support extending between the top support and the bottom support;

at least one top pulley rotatably coupled to the first side and a bottom pulley rotatably coupled to the bottom support;

a main pulley rotatably coupled to a band slide;

a main slide coupled to the main support and adjustably moveable relative to the main support;

a first stopper and a second stopper coupled to the main slide;

a cable having a first end passing through the first stopper and second end, passing through the second stopper and having a length between the first stopper and the second stopper that runs between the at least one top pulley, the bottom pulley, the main pulley and the band slide, wherein the first end has a first handle attachment and the second end has a second handle attachment, wherein pulling on the first handle attachment or the second handle attachment shortens the length between the first stopper and the second stopper; and at least one band removably coupled to the band slide and a bottom band retainer.

* * * * *